US010598461B2

(12) United States Patent
Lort

(10) Patent No.: US 10,598,461 B2
(45) Date of Patent: Mar. 24, 2020

(54) HIGH PRESSURE AIR SYSTEM FOR AIRSOFT GUN

(71) Applicant: Wolverine Airsoft, LLC, Kingsport, TN (US)

(72) Inventor: Rich Lort, Kingsport, TN (US)

(73) Assignee: Wolverine Airsoft, LLC, Kingsport, TN (US)

( * ) Notice: Subject to any disclaimer, the term of this patent is extended or adjusted under 35 U.S.C. 154(b) by 0 days.

(21) Appl. No.: 15/901,565

(22) Filed: Feb. 21, 2018

(65) Prior Publication Data

US 2018/0180377 A1 Jun. 28, 2018

Related U.S. Application Data

(63) Continuation-in-part of application No. 14/791,851, filed on Jul. 6, 2015, now Pat. No. 9,903,684.

(60) Provisional application No. 62/020,458, filed on Jul. 3, 2014, provisional application No. 62/048,590, filed on Sep. 10, 2014.

(51) Int. Cl.

| | |
|---|---|
| ***F41B 11/00*** | (2013.01) |
| ***F41B 11/723*** | (2013.01) |
| ***F41B 11/62*** | (2013.01) |
| ***F41B 11/73*** | (2013.01) |

(52) U.S. Cl.

CPC ..... *F41B 11/723* (2013.01); *F41B 11/62* (2013.01); *F41B 11/73* (2013.01)

(58) Field of Classification Search

CPC ..... F41B 11/72; F41B 11/73; F41B 11/721; F41B 11/723; F41B 11/62; F41B 11/57; F41B 11/71

USPC ..... 124/73–77

See application file for complete search history.

(56) References Cited

U.S. PATENT DOCUMENTS

| | | | | |
|---|---|---|---|---|
| 4,770,153 | A | 9/1988 | Edelman | |
| 5,613,483 | A | 3/1997 | Lukas et al. | |
| 5,778,868 | A | 7/1998 | Shephard | |
| 6,601,780 | B1 | 8/2003 | Sheng | |
| 6,925,997 | B2 | 8/2005 | Sheng | |
| 7,121,273 | B2 | 10/2006 | Styles | |
| 7,229,796 | B2 | 6/2007 | Kirwan | |
| 7,299,796 | B2 * | 11/2007 | Kirwan | F41B 11/62 124/71 |
| 7,509,953 | B2 | 3/2009 | Wood | |
| 7,527,049 | B2 * | 5/2009 | Sheng | F41B 11/721 124/73 |
| 7,533,664 | B2 | 5/2009 | Carnall | |
| 7,603,997 | B2 | 10/2009 | Hensel et al. | |
| 7,624,727 | B2 | 12/2009 | Campo | |
| 7,640,926 | B2 | 1/2010 | Jones | |
| 7,712,464 | B2 | 5/2010 | Lian | |
| 7,730,881 | B1 | 6/2010 | Pedicini et al. | |

(Continued)

*Primary Examiner* — Michael D David

(74) *Attorney, Agent, or Firm* — Pitts & Lake, P.C.

(57) ABSTRACT

A high pressure air cylinder-nozzle assembly includes a cylinder frame body, a piston assembly including a piston base member and a nozzle, the piston base member being configured to move along an axis in the cylinder frame body relative to the nozzle in at least one stage of multi-stage piston assembly movements between forward and back positions, and simultaneously with the nozzle in at least another stage of the multi-stage piston assembly movements, and a solenoid valve to direct air to the piston base member to move the piston base member between the forward and back positions.

18 Claims, 11 Drawing Sheets

(56) References Cited

U.S. PATENT DOCUMENTS

| | | | | |
|---|---|---|---|---|
| 7,735,479 | B1 | 6/2010 | Quinn et al. | |
| 7,762,247 | B2 | 7/2010 | Evans | |
| 7,770,572 | B2 | 8/2010 | Lian | |
| 7,861,703 | B2 | 1/2011 | Liao | |
| 7,921,839 | B2 * | 4/2011 | Wood | F41B 11/721 124/73 |
| 7,931,018 | B1 | 4/2011 | Lai | |
| 7,997,260 | B2 | 8/2011 | Kaakkola et al. | |
| 8,033,276 | B1 | 10/2011 | Gabrel | |
| 8,104,463 | B2 | 1/2012 | Wood | |
| 8,201,547 | B2 * | 6/2012 | Wood | F41B 11/721 124/75 |
| 8,267,077 | B2 * | 9/2012 | Kaakkola | F41B 11/721 124/74 |
| 8,272,373 | B2 | 9/2012 | Masse | |
| 8,336,532 | B2 | 12/2012 | Masse | |
| 8,453,633 | B2 | 6/2013 | Tsai | |
| 8,485,172 | B2 | 7/2013 | Tseng | |
| 8,671,928 | B2 | 3/2014 | Hague et al. | |
| 9,033,306 | B2 | 5/2015 | Kunau | |
| 9,080,832 | B2 | 7/2015 | Brahler, II et al. | |
| 9,297,606 | B2 | 3/2016 | Harvey et al. | |
| 2002/0096164 | A1 | 7/2002 | Perrone | |
| 2003/0005918 | A1 | 1/2003 | Jones | |
| 2004/0200115 | A1 | 10/2004 | Monks et al. | |
| 2007/0119988 | A1 | 5/2007 | Sheng | |
| 2008/0127960 | A1 | 6/2008 | Gan | |
| 2012/0216786 | A1 | 8/2012 | Hadley et al. | |
| 2013/0247893 | A1 | 9/2013 | Yang | |
| 2016/0033230 | A1 * | 2/2016 | Lort | F41B 11/723 124/77 |
| 2018/0180377 | A1 * | 6/2018 | Lort | F41B 11/723 |

* cited by examiner

HIGH PRESSURE AIR SYSTEM FOR AIRSOFT GUN

CROSS-REFERENCE TO RELATED APPLICATIONS

This Application is a continuation-in-part of U.S. patent application Ser. No. 14/791,851, filed on Jul. 6, 2015, which claims the benefit of U.S. Provisional Patent Application Ser. No. 62/020,458, filed on Jul. 3, 2014, and of U.S. Provisional Patent Application Ser. No. 62/048,590, filed on Sep. 10, 2014. The content of all listed foregoing applications is incorporated herein by reference.

STATEMENT REGARDING FEDERALLY SPONSORED RESEARCH OR DEVELOPMENT

Not Applicable.

FIELD OF INVENTION

The present invention pertains generally to airsoft guns, and, more particularly, to a high pressure fluid mechanism to be used in airsoft guns.

BACKGROUND

Airsoft guns employ compressed air to fire round plastic pellets or similar projectiles, usually ranging from 0.12 g to 0.48 g. Airsoft players often fire airsoft guns at other players during airsoft games and competitions.

Various "firing" mechanisms are known in the art for airsoft guns. For instance, U.S. Pat. No. 7,527,049, issued to Sheng, discloses a pneumatic pusher having a main body, a flow-guiding body, a moving body, and a delivery tube. The flow-guiding body includes a front tube with a smaller diameter and a rear tube with a larger diameter. The delivery tube is mounted on the front tube in such a way that the outer wall of the delivery tube and the inner wall of the main body define a return pressure chamber. A first gas-distributing channel extending from a first air outlet at one side of the main body leads directly to the inner side of the delivery tube. The side of the first air inlet of the main body communicates with a second gas-distributing channel. The second gas-distributing channel includes an exit located at one side of the return pressure chamber of the delivery tube. The air pressure provided through the second gas-distributing channel serves as cushioning force in pushing the delivery tube outwardly.

U.S. Pat. No. 8,453,633, issued to Tsai, discloses a spring-piston airsoft gun that includes a cylinder-and-piston assembly disposed in a barrel to force air through a muzzle end to make a shooting action, and a coil spring disposed to exert a biasing action to drive a piston head of the cylinder-and-piston assembly when changed from a compressed state to a released state. Front and rear anchor shanks are disposed for respectively mounting front and rear coil segments of the coil spring. A major shell and a minor ring are sleeved on the rear anchor shank to permit the coil spring to be sleeved thereon. The minor ring is in frictional contact with and angularly moveable relative to the major shell such that, when the coil spring is released to expand to the released state, the rear coil segment is tensed to drag the minor ring to angularly move therewith so as to minimize the frictional force therebetween.

U.S. Pat. No. 8,671,928, issued to Hague et al. and assigned to Polarstar Engineering & Machine, discloses a pneumatic assembly for a projectile launching system includes a body defining a continuous bore. A nozzle is positioned within the bore adjacent a forward end and is moveable between a rearward position wherein the nozzle facilitates passage of a projectile through a projectile port and a forward position wherein the nozzle prevents passage of a projectile through the projectile port. The nozzle is biased to the forward position and configured for fluid actuation to the rearward position by activation of a first fluid control valve. A valve seat defines an accumulation chamber rearward of the nozzle. A firing valve member is moveable between a forward position wherein the firing valve member fluidly seals a passage through the valve seat and a rearward position wherein the passage is fluidly opened such that fluid in the accumulation chamber is free to flow through the passage and out of the nozzle. Example embodiments of this pneumatic assembly generally include a nozzle spring contained between the rear surface of the nozzle and the front surface of a center cylinder.

U.S. Patent Application Publication Number 2012/0216786, by Hadley and Calvin, teaches a soft impact projectile launcher including a launching mechanism that creates a burst of air or air pressure in order to launch a projectile. The launching mechanism includes an outer cylinder and a spring-loaded piston configured to generate the burst of air. The projectile launcher may also include a projectile reservoir and a loading member that positions projectiles for launching. The projectile launcher can launch projectiles that are made from a superabsorbent polymer and consist of mostly water.

U.S. Patent Application Publication Number 2013/0247893, by Yang, teaches an airsoft gun structure designed to shunt high-pressure air flow during shooting. Therefore, the shunted high-pressure air flow simulates recoils as real bolt-action, single-shot rifles. Also, the ammunition supply includes different cartridges to select one of the supply-type by the users and whether shell case ejection or not. When operates the airsoft gun, the realistic action is achieved to enhance the fun of shooting. Furthermore, the dual hop up system makes the flight path of bullets more stable without shift. Moreover, the safety gasification system could make the supplied amount of the output compressed high pressure air be almost constant to enhance security during operation. The devices disclosed in Yang include a hammer block spring or magazine spring attached to an inner surface of the back block in an inner barrel.

BRIEF SUMMARY OF THE INVENTION

The present general inventive concept, in some of its many embodiments, encompasses a springless high pressure air cylinder to use in an airsoft gun or similar devices and systems. In some embodiments, the present general inventive concept encompasses a cylinder in which an imbalanced poppet valve directs and controls the axial motion of a piston. Some embodiments include a two-way solenoid valve. The solenoid valve controls the flow of air to drive a piston forward; air then pushes the piston back into place.

Additional aspects and advantages of the present general inventive concept will be set forth in part in the description which follows, and, in part, will be obvious from the description, or may be learned by practice of the present general inventive concept.

In some embodiments of the present general inventive concept, a springless high pressure air cylinder for use in an airsoft gun includes a cylinder frame body, a piston having a nozzle member and a piston base member, the piston base member moving within the cylinder frame body along an axis, the piston base member including a first piston head surface and a second piston head surface, the piston being capable of moving between a forward position and a back position, a solenoid valve to direct air to the piston base member, whereby air pressure on the first piston head surface moves the piston from the back position to the forward position, and an auxiliary line to direct air against the second piston head surface, whereby air pressure on the second piston head surface moves the piston from the forward position to the back position.

In some embodiments, the auxiliary line is a part of the cylinder frame body. In some embodiments, the auxiliary line is separate from the cylinder frame body.

In some embodiments, the solenoid valve is a two-way solenoid valve.

Some embodiments further encompass a baffle member interposed between said piston base member and said cylinder frame body.

In some embodiments of the present general inventive concept, a high pressure air cylinder-nozzle assembly includes a cylinder frame body, a piston having a nozzle member and a piston base member, the piston base member moving within the cylinder frame body, the piston being capable of moving between a forward position and a back position, the piston base member including a primary piston head surface and a secondary piston head surface, a solenoid valve to direct air to the piston base member at a location proximate the primary piston head surface, air pressure on the primary piston head surface moving the piston from the back position to the forward position, and a secondary air line to direct air against the secondary piston head surface, air pressure on the secondary piston head surface moving the piston from the forward position to the back position.

Certain embodiments are further characterized in that the high pressure air cylinder-nozzle assembly is used in an airsoft gun.

Certain embodiments are further characterized by a spring positioned within the cylinder frame body to assist in moving the piston from the forward position to the back position.

Certain embodiments are further characterized by a spring positioned within the cylinder frame body to assist in moving the piston from the back position to the forward position.

Certain embodiments are further characterized in that the secondary air line is a part of the cylinder frame body.

Certain embodiments are further characterized in that the solenoid valve is a two-way solenoid valve.

Some embodiments further encompass a baffle member interposed between said piston base member and said cylinder frame body.

Certain embodiments are further characterized in that said baffle member includes air slits air slits permitting passage of air from said secondary air line to said secondary piston head surface when said piston from is in the forward position.

Certain embodiments are further characterized in that the primary piston head surface and the secondary piston head surface are opposing surfaces of one piston member.

In some embodiments of the present general inventive concept, a high pressure cylinder for use in a gun includes a cylinder frame body, a piston having a nozzle member and a piston base member, the piston base member moving within the cylinder frame body along an axis, the piston base member including a first piston head surface and a second piston head surface, the piston being capable of moving between a forward position and a back position, a solenoid valve to direct a fluid to the piston base member, whereby fluid pressure on the first piston head surface moves the piston from the back position to the forward position, and an auxiliary fluid line to direct fluid against the second piston head surface, whereby fluid pressure on the second piston head surface moves the piston from the forward position to the back position.

In some embodiments, the auxiliary line is a part of the cylinder frame body.

In some embodiments, the solenoid valve is a two-way solenoid valve.

Some embodiments further encompass a baffle member interposed between said piston base member and said cylinder frame body.

In some embodiments, said baffle member includes air slits permitting passage of air from said secondary air line to said secondary piston head surface when said piston from is in the forward position.

In some embodiments, said primary piston head surface and said secondary piston head surface are opposing surfaces of one piston member.

The foregoing and/or other aspects and advantages of the present general inventive concept may be achieved by a high pressure air cylinder-nozzle assembly, including a cylinder frame body, a piston assembly including a piston base member and a nozzle, the piston base member being configured to move along an axis in the cylinder frame body relative to the nozzle in at least one stage of multi-stage piston assembly movements between forward and back positions, and simultaneously with the nozzle in at least another stage of the multi-stage piston assembly movements, and a solenoid valve to direct air to the piston base member to move the piston base member between the forward and back positions.

Other features and aspects may be apparent from the following detailed description, the drawings, and the claims.

BRIEF DESCRIPTION OF THE DRAWINGS

The following example embodiments are representative of example techniques and structures designed to carry out the objects of the present general inventive concept, but the present general inventive concept is not limited to these example embodiments. In the accompanying drawings and illustrations, the sizes and relative sizes, shapes, and qualities of lines, entities, and regions may be exaggerated for clarity. A wide variety of additional embodiments will be more readily understood and appreciated through the following detailed description of various example embodiments, with reference to the accompanying drawings in which.

DETAILED DESCRIPTION OF THE INVENTION

Reference will now be made to the example embodiments of the present general inventive concept, examples of which are illustrated in the accompanying drawings, illustrations, and photographs. The example embodiments are described herein in order to explain the present general inventive concept by referring to the figures.

The following detailed description is provided to assist the reader in gaining a comprehensive understanding of the structures and fabrication techniques described herein. Accordingly, various changes, modification, and equivalents of the structures and fabrication techniques described herein will be suggested to those of ordinary skill in the art. The progression of fabrication operations described are merely examples, however, and the sequence type of operations is not limited to that set forth herein and may be changed as is known in the art, with the exception of operations necessarily occurring in a certain order. Also, description of well-known functions and constructions may be simplified and/or omitted for increased clarity and conciseness.

Note that spatially relative terms, such as "up," "down," "right," "left," "beneath," "below," "lower," "above," "upper" and the like, may be used herein for ease of description to describe one element or feature's relationship to another element(s) or feature(s) as illustrated in the figures. Spatially relative terms are intended to encompass different orientations of the device in use or operation in addition to the orientation depicted in the figures. For example, if the device in the figures is turned over or rotated, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

Disclosed herein are various example embodiments of a springless high pressure air cylinder to use in an airsoft gun or similar devices and systems. In some embodiments, the present general inventive concept encompasses a cylinder in which an imbalanced poppet valve directs and controls the axial motion of a piston. Some embodiments include a two-way solenoid valve. The solenoid valve controls the flow of air to drive a piston forward; air then pushes the piston back into place.

Figure 1:
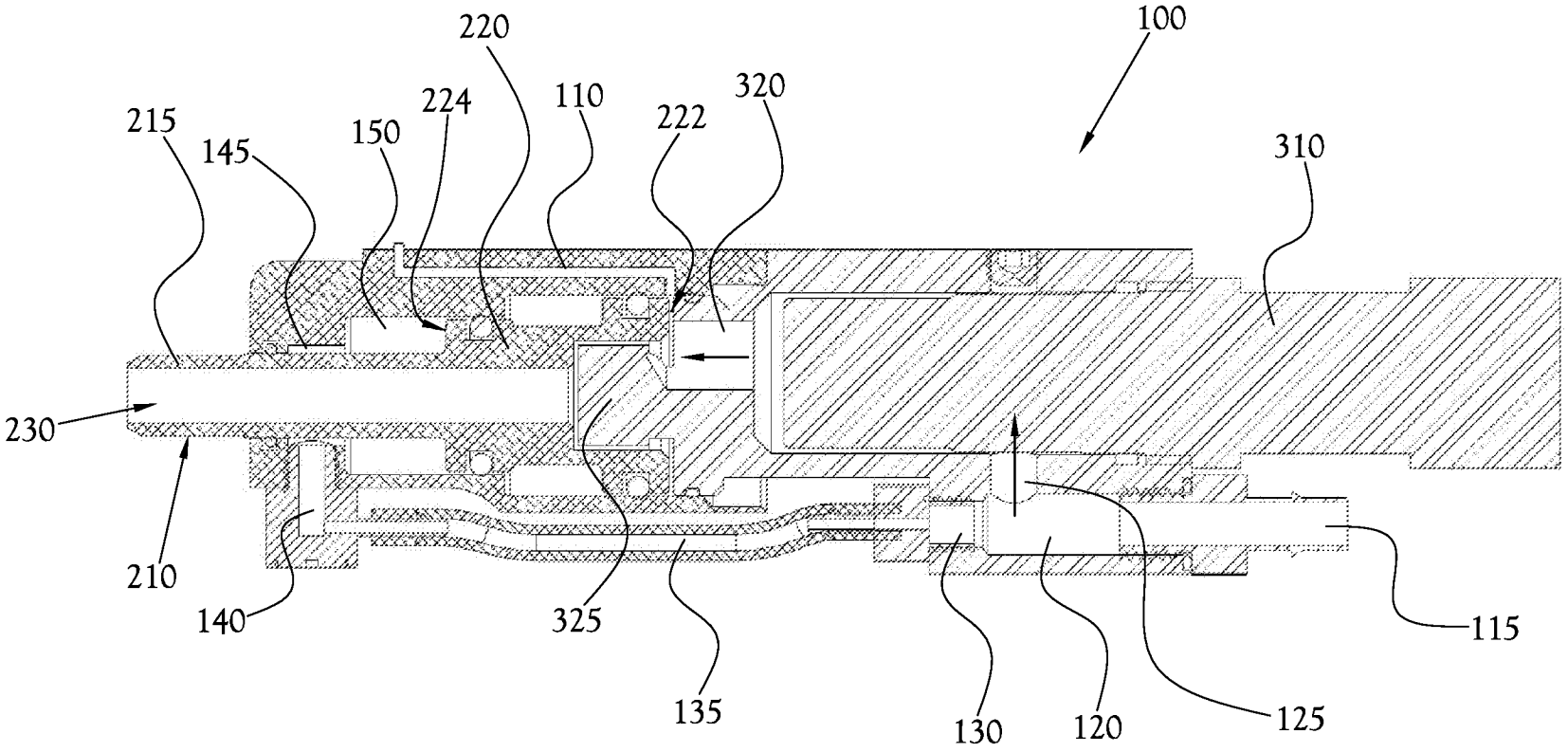
FIG. 1 is a section view of a cylinder-nozzle assembly according to one example embodiment of the present general inventive concept, showing the piston and nozzle in the "back" position.

Turning to the figures, FIG. 1 shows a cross-section view of one example embodiment of a cylinder-nozzle assembly according to the present general inventive concept. In FIG. 1, the cylinder-nozzle assembly 100 includes a cylinder frame body 110, a piston 210, and a solenoid 310. A substantial portion of the piston 210 fits within the cylinder frame body 110 and moves within the cylinder frame body 110. The piston 210 includes a nozzle 215 (which defines the central air channel 230) and a piston head portion 220.

FIG. 1 shows the cylinder-nozzle assembly 100 with the piston 210 in a "back" or rest position. In the back position, the piston head portion 220 and part of the nozzle 215 fit within an interior volume 150 defined by the surrounding cylinder frame body 110, and the piston head portion 220 of the piston 210 fits closely (but generally not in an air-tight fit) against and partially wraps around a central head member 325. To move the piston 210, high pressure air enters the assembly through an air input channel 115, which feeds to a HPA compartment 120. From the HPA compartment 120, air passes through a solenoid input channel 125 into the solenoid 310. Within the solenoid 310 is a valve, which is capable of switching between a closed state and an open state. When a trigger mechanism of the airsoft gun activates the solenoid 310, the valve within the solenoid 310 switches into its open state, allowing the passage of air from the input channel through the solenoid 310 and into an antepiston compartment 320 defined by the cylinder frame body 110 and proximate to the piston head portion 220 of the piston 210.

Figure 2:
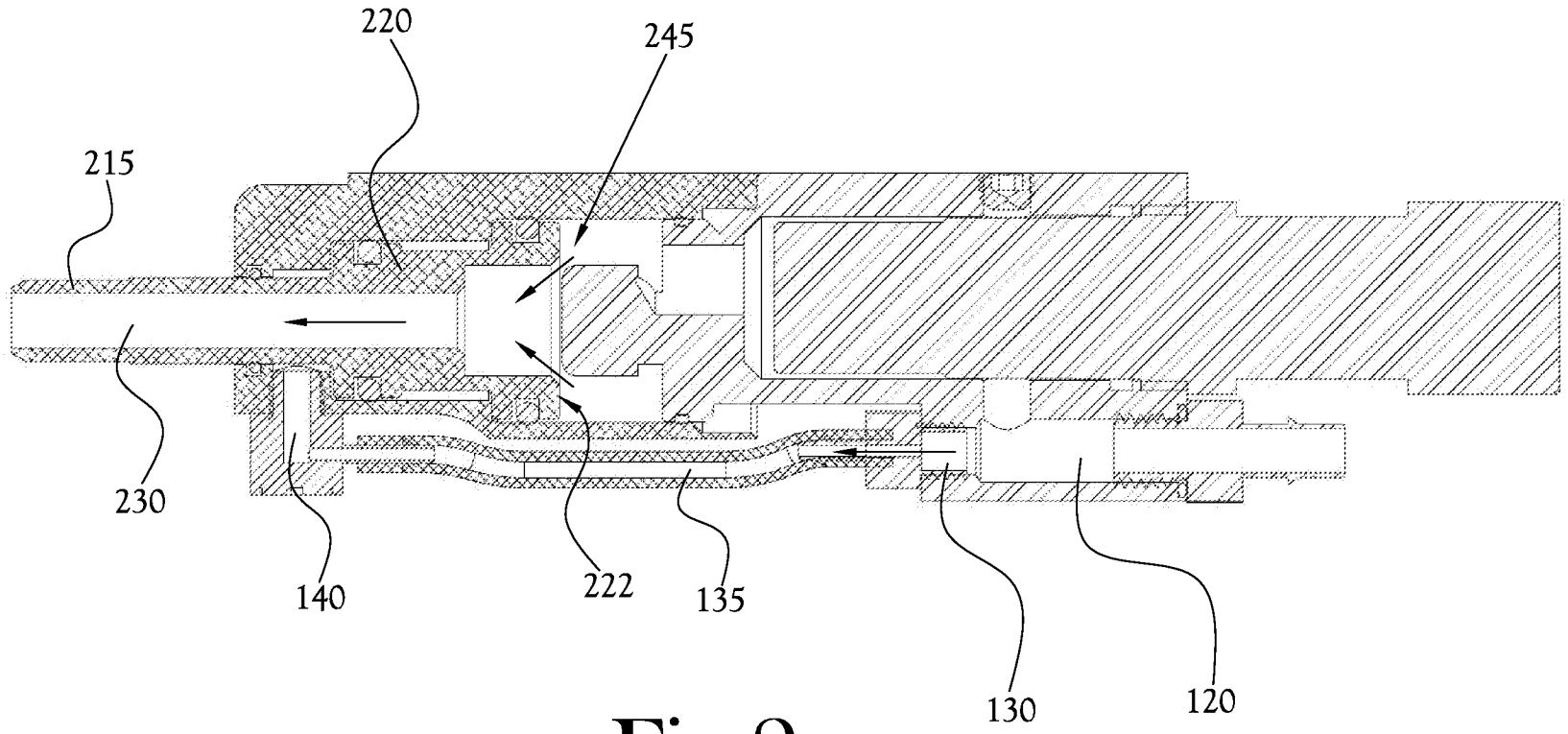
FIG. 2 is a second section view of the example embodiment cylinder-nozzle assembly shown in FIG. 1, showing piston and nozzle in the "forward" position.
Figure 3:
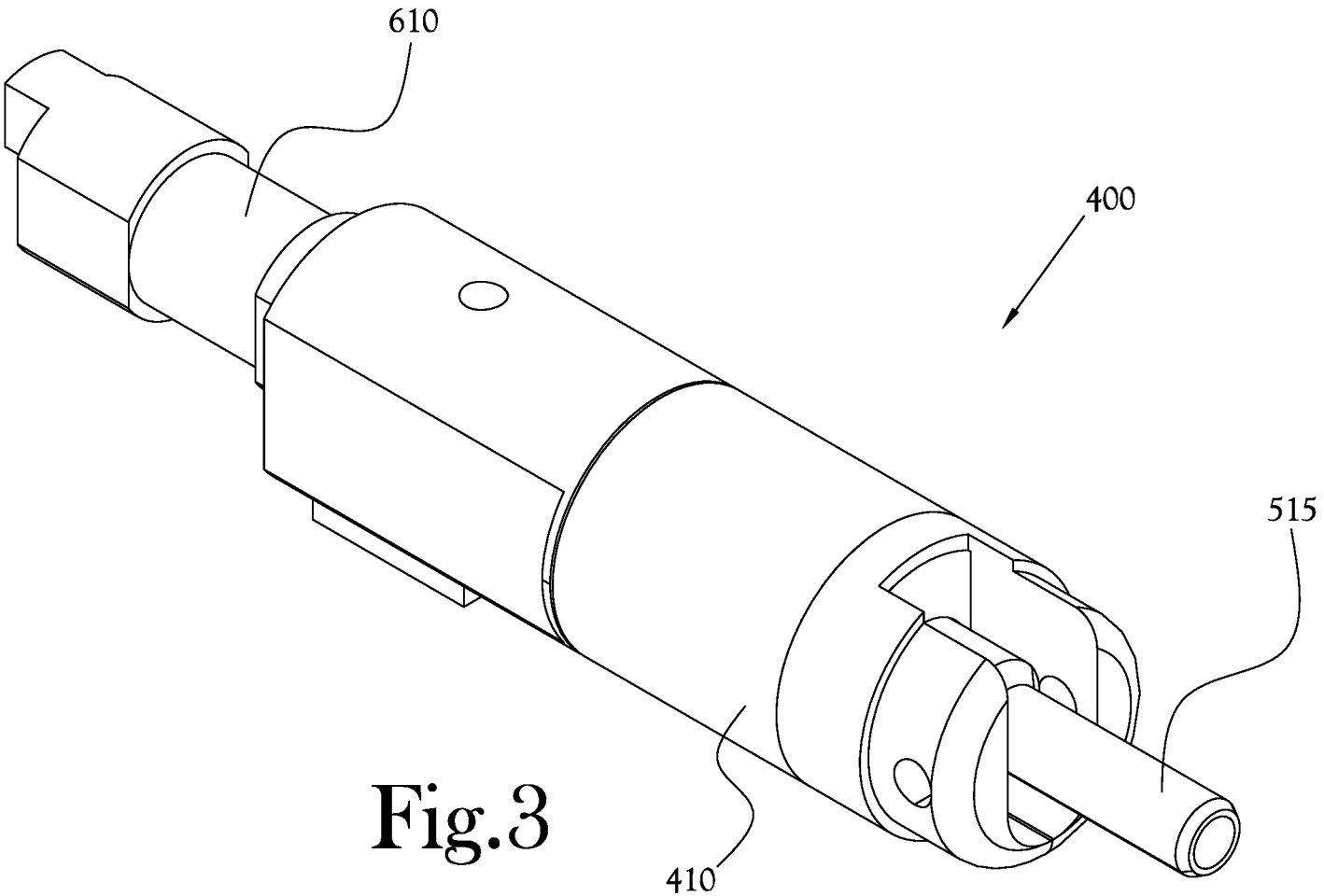
FIG. 3 is a perspective view of a cylinder-nozzle assembly according to one example embodiment of the present general inventive concept.
Figure 4:
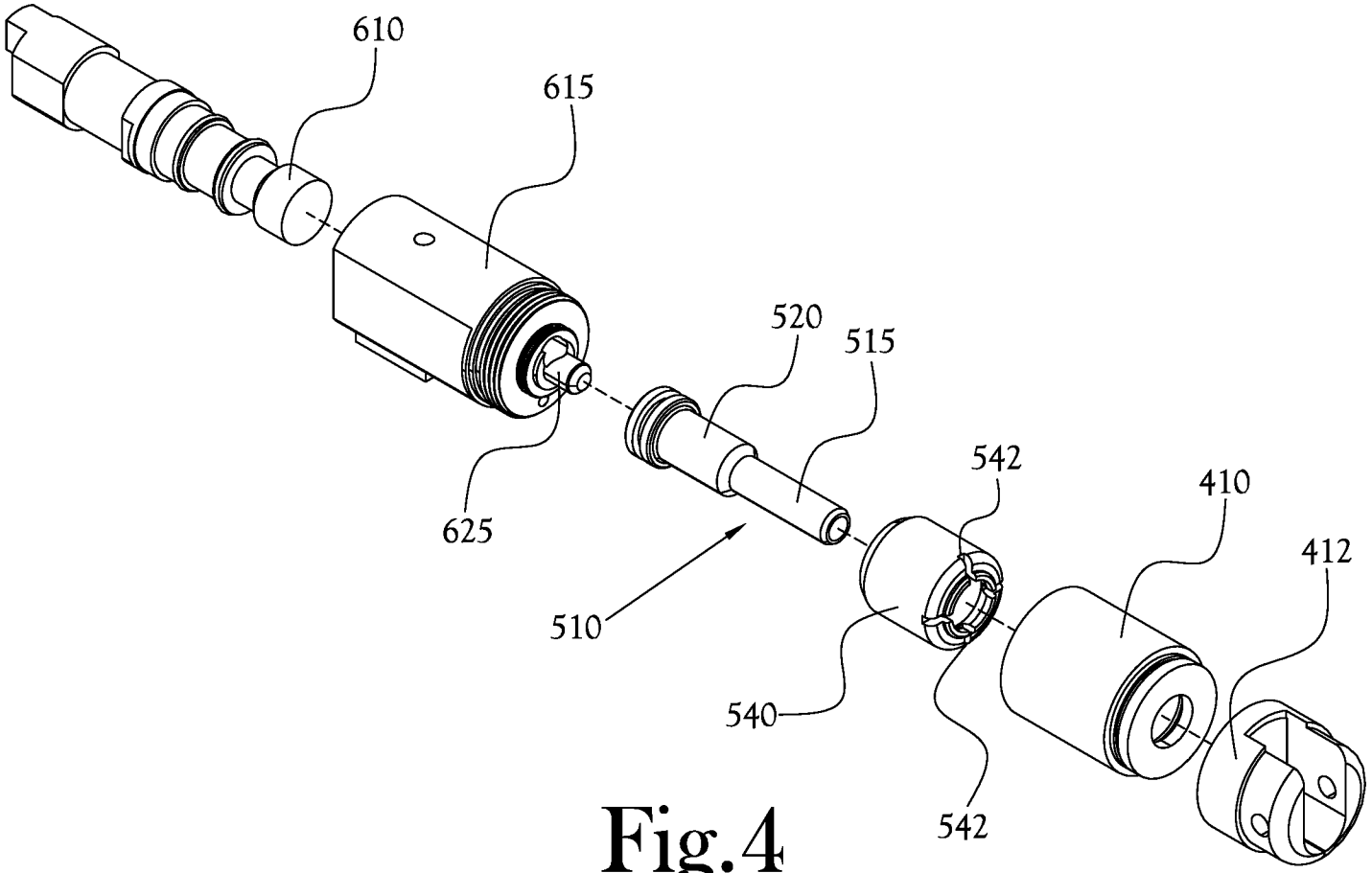
FIG. 4 is an exploded view of the example embodiment shown in FIG. 3.
Figure 5:
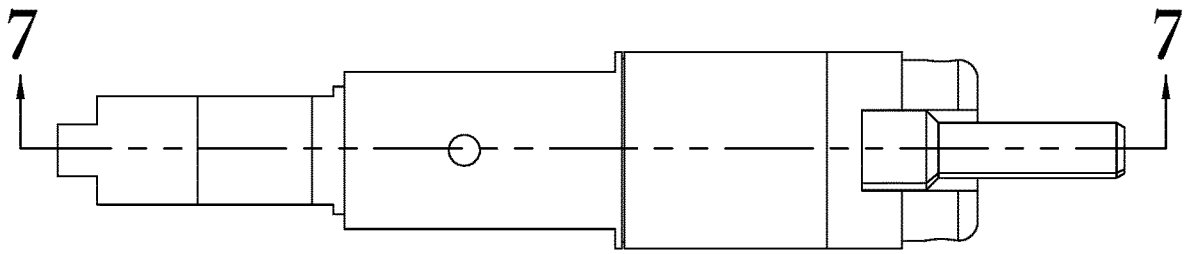
FIG. 5 is a top-down view of the example embodiment shown in FIGS. 3 and 4, showing the section-line along which is taken the views of FIGS. 6 and 7.

As air flows into the antepiston compartment 320, the air pushes on a primary piston head surface 222. Air pressure on the primary piston head surface 222 pushes the piston 210 forward within the cylinder frame body 110, until the piston 210 is in a "forward" position, illustrated in FIG. 2. Once the piston 210 is in the forward position, air from the solenoid 310 passed into the antepiston compartment 320 is free to travel through the open space 245 between the piston head portion 220 and the central head member 325; from there the air passes through the central air channel 230 defined by the nozzle 215.

With the piston 215 in the forward position, the valve within the solenoid 310 closes, and high pressure air being fed into the HPA compartment 120, instead of flowing through the solenoid 310, flows through an auxiliary tube 130 and auxiliary line 135 into a forward air feed tube, which feeds the air into a forward air compartment 145 within the cylinder frame body 110. The air in the forward air compartment 145 exerts pressure on a secondary piston head surface 224, and that pressure drives the piston 210 to return to the back position shown in FIG. 1.

In some embodiments of the present general inventive concept, the two piston surfaces are opposite sides of the same piston, with the center diameter of the two sides differing—thereby leading to a difference in the surface area of the two piston surfaces.

Some further example embodiments of the present general inventive concept include assemblies in which a spring positioned within the cylinder frame body assists in returning the piston to the back position. This spring, then, supplements the motive force of the air supplied by the auxiliary line. Some further example embodiments of the present general inventive concept include assemblies in which a spring positioned within the cylinder frame body assists in returning the piston to the forward position. This spring, then, supplements the motive force of the air supplied by the auxiliary line.

In some embodiments, the cylinder-nozzle assembly is designed to fit into an existing gear box. In some embodiments, the cylinder-nozzle assembly is designed to operate as a stand-alone unit to fit into an airsoft gun or other similar device or system.

FIGS. 3-7 illustrate one example embodiment of a cylinder-nozzle assembly according to the present general inventive concept. As shown in the perspective view in FIG. 3, and in the exploded view of the same embodiment in FIG. 4, the assembly 400 includes a frame body 410, a piston 510 with nozzle 515 and piston base 520, and a solenoid 610. In the illustrated example embodiment, as shown in the cross-sectional view in FIG. 6, a substantial portion of the piston 510 fits within the cylinder frame body 410 and moves within the cylinder frame body 410. The piston 510 includes a nozzle 515 (which defines a central air channel 530) and a piston base 520. As shown in the exploded view of FIG. 4 and in the cross-sectional views in FIGS. 6 and 7, a baffle member 540 fits over the piston base 520; the piston base 520 moves within the volume enclosed by the baffle member 540, and the baffle member 540 includes an aperture permitting through-passage by the nozzle 515. In some embodiments, the baffle member 540 includes one or more air slits 542 proximate the aperture and the nozzle 515.

Figure 6:
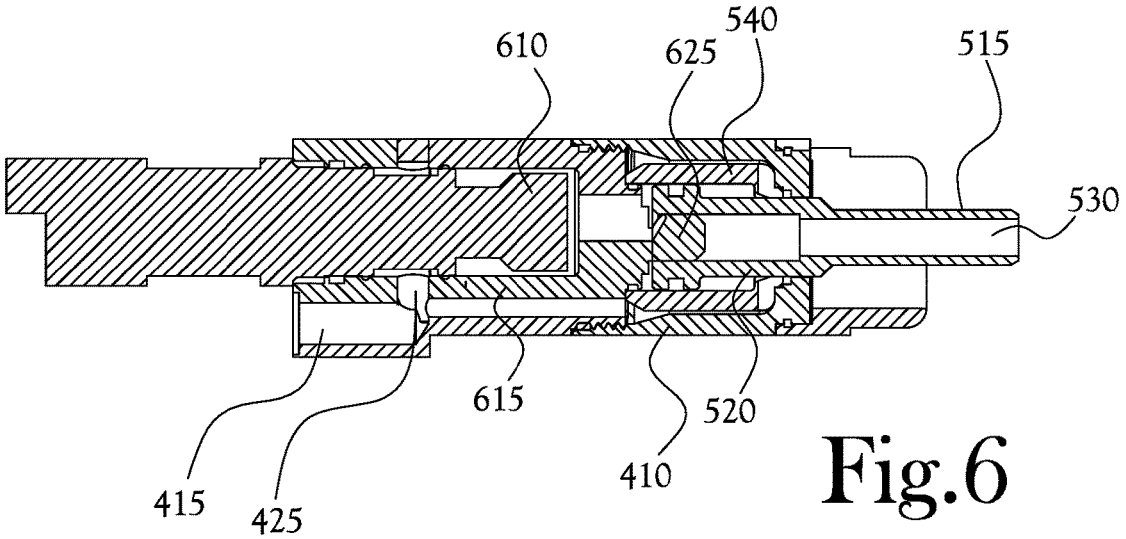
FIG. 6 is a section view of the example embodiment cylinder-nozzle assembly shown in FIGS. 3-5, showing piston and nozzle in the "back" position.
Figure 7:
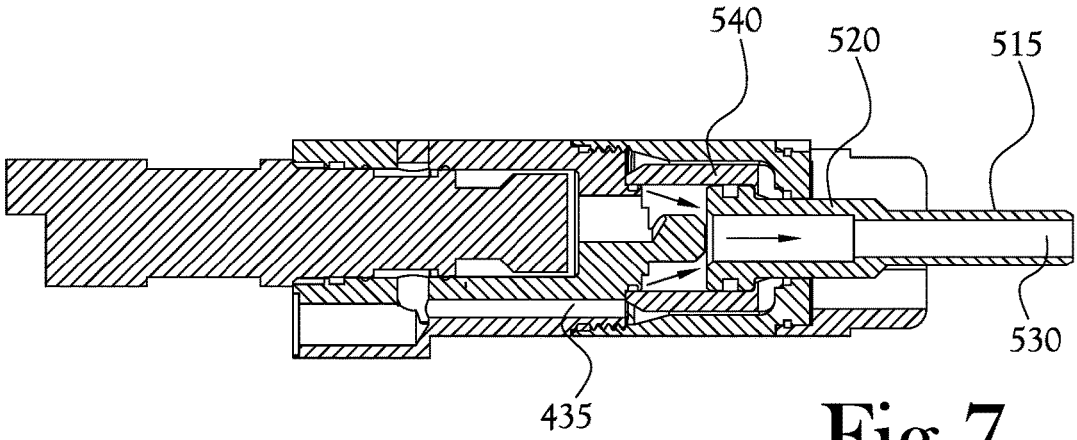
FIG. 7 is a second section view of the example embodiment cylinder-nozzle assembly shown in FIGS. 3-6, showing piston and nozzle in the "forward" position.

The cross-sectional view of FIG. 6 shows the cylinder-nozzle assembly 400 with the piston 510 in a "back" or rest position. In the back position, the piston base 520 sits within the baffle member 540 and the cylinder frame body 410 positioned towards the solenoid 610. The piston base 520 fits closely (but generally not in an air-tight fit) against and partially wraps around a central head member 625 of the solenoid 610.

To move the piston 510, high pressure air enters the assembly through an air input channel to a HPA compartment 415. From the HPA compartment 415, air passes through a solenoid input channel 425 into the solenoid 610. Within the solenoid 610 is a valve, which is capable of switching between a closed state and an open state. When a trigger mechanism of the airsoft gun activates the solenoid 610, the valve within the solenoid 610 switches into its open state, allowing the passage of air from the input channel through the solenoid 610 and into an antepiston compartment defined by the cylinder frame body 110 and proximate to both the central head member 625 and to the piston base 520. As air flows into the antepiston compartment, the air pushes on a primary piston head surface. Air pressure on the primary piston head surface pushes the piston base 520 forward within the cylinder frame body 410 and baffle member 540, until the piston 510 is in a "forward" position, illustrated in the cross-sectional view in FIG. 7. Once the piston 510 is in the forward position, air from the solenoid 610 passed into the antepiston compartment is free to travel through the open space between the piston base 520 and the central head member 325; from there the air passes through the central air channel 530 defined by the nozzle 515.

With the piston 510 in the forward position, the valve within the solenoid 610 closes, and high pressure air being fed into the HPA compartment 415, instead of flowing through the solenoid 610, flows through a secondary air line 435, which feeds the air into a forward air compartment within the cylinder frame body 410. The air in the forward air compartment exerts pressure on a secondary piston head surface, and that pressure drives the piston 510 to return to the back position shown in FIG. 6. In some example embodiments, the air slits 542 in the baffle member 540 permit the passage of air from the secondary air line to the secondary piston head surface. In some embodiments, the primary piston head surface and the secondary piston head surface are opposing surfaces of one piston member. In some embodiments, the two piston surfaces are opposite sides of the same piston, with the center diameter of the two sides differing—thereby leading to a difference in the surface area of the two piston surfaces.

Figure 8:
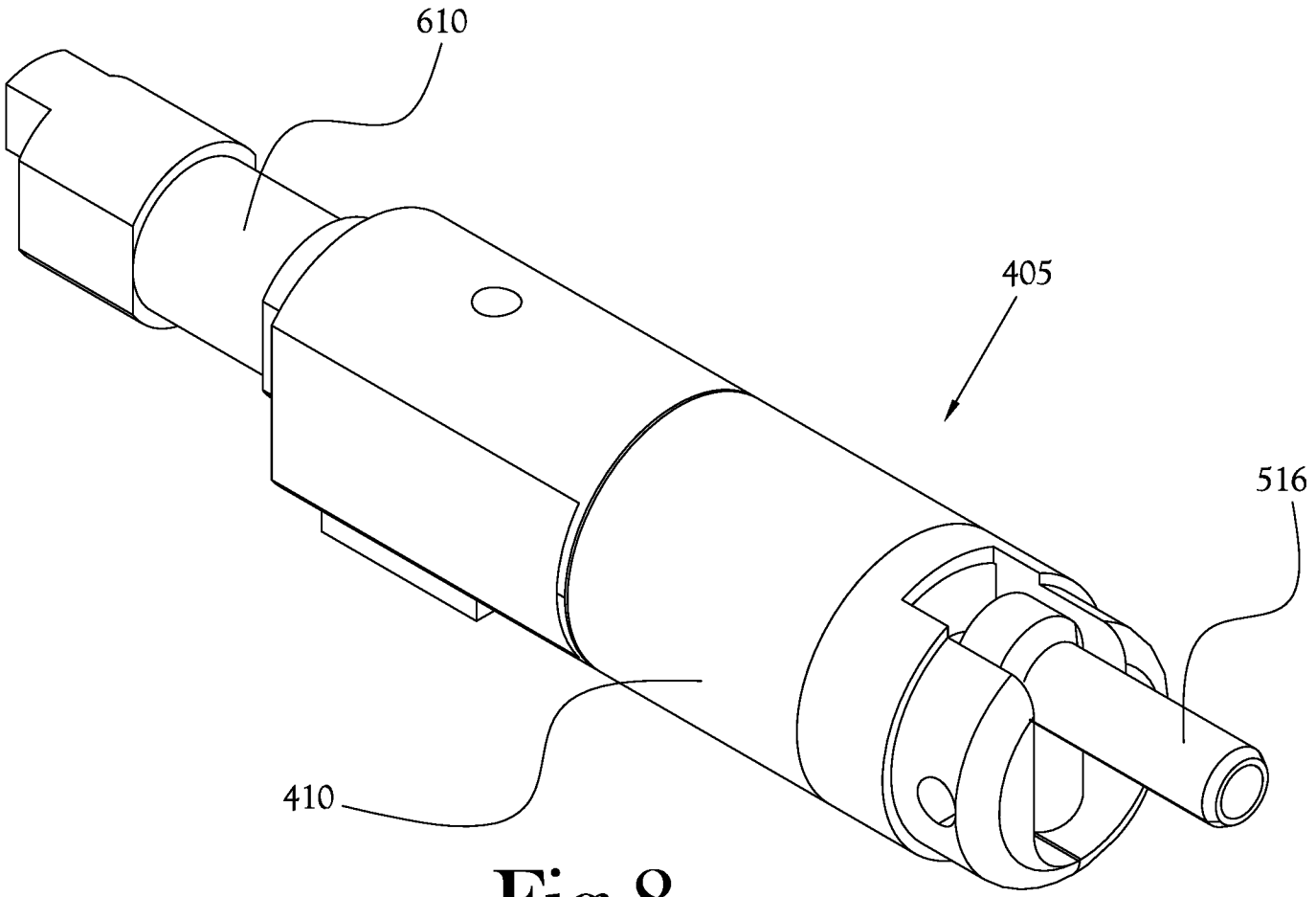
FIG. 8 is a perspective view of another cylinder-nozzle assembly according to another example embodiment of the present general inventive concept, showing a cylinder-nozzle assembly with an off-set nozzle.

In the example embodiments illustrated thus far, the nozzle is substantially centered with respect to the cylinder frame body. However, other configurations are contemplated by the present general inventive concept. For example, FIG. 8 shows a perspective view of a cylinder-nozzle assembly 405 with an off-set nozzle 516. Other variations and configurations will be apparent to those of skill in the art and are also within the scope of the present general inventive concept.

In various example embodiments of the present general inventive concept, air flow through the cylinder-nozzle assembly may be altered by providing a multiple part piston and nozzle assembly that is configured to result in multi-stage movement in the cylinder-nozzle assembly. For example, rather than air moving directly into an antepiston compartment to gather and begin to move the piston, as described in reference to FIG. 1 of the present application, the air from the solenoid may be applied directly to the piston, and a portion of the piston may move a predetermined distance to effectively create an antepiston compartment to build further pressure before the air is released to the central air channel. Such an example embodiment is described in reference to FIGS. 9-14.

Figure 9:
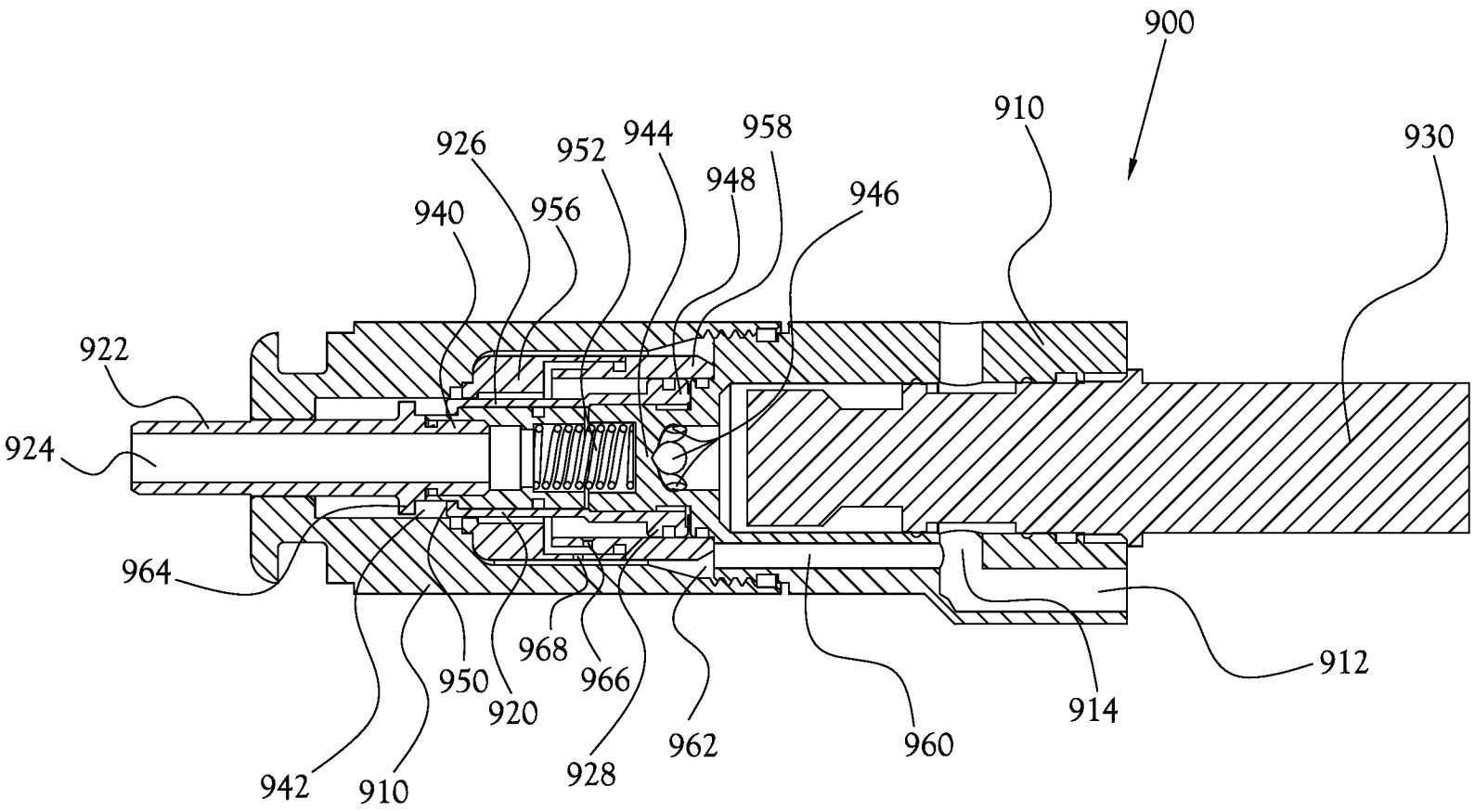
FIG. 9 illustrates a cylinder-nozzle assembly configured to have multi-stage forward and rear movement according to an example embodiment of the present general inventive concept.

FIG. 9 illustrates a cylinder-nozzle assembly configured to have multi-stage forward and rear movement according to an example embodiment of the present general inventive concept. In the example embodiment illustrated in FIG. 9, the cylinder-nozzle assembly 900 includes a cylinder frame body 910, a piston 920, and a solenoid 930, similar to the example embodiments illustrated in FIGS. 1 and 6. However, in the example embodiment illustrated in FIG. 9, the piston 920 includes separate components that may move relative to one another. For example, rather than being fixed to the piston base portion 928, the nozzle 922 is coupled to a piston insert 940 that is provided substantially inside the piston base portion 928, and the piston base portion 928 is configured to move at least partially relative to the nozzle 922 and piston insert 940. For ease of description, all of the piston base portion 928, piston insert 940, and nozzle 922 may be referred to as the piston 920, though it is evident that various components may be formed separately, and in some example embodiments even of different materials. Such relative movement between the components will be described in more detail in the discussion of the subsequent drawings. Substantial portions of the piston 920 are configured to fit and move within the cylinder frame body 910, and the nozzle 922 defines a central air channel 924.

FIG. 9 illustrates the cylinder-nozzle assembly 900 with the piston 920 in the "back" or rest position. In the back position, the piston base portion 928 and part of the nozzle 922 fit within an interior volume 942 defined by the surrounding cylinder frame body 910, and the piston base portion 928 fits closely against the solenoid 930 and wraps around a central head member 944. In a recess configured as a thin neck between the solenoid 930 and the central head member 944, a plurality of air ports 946 are provided which will exhaust high pressure air onto the piston base portion 928. Although the example embodiment illustrated in FIG. 9 shows the ports 946 being configured to transfer air into an inner surface of the piston base portion 928, it is noted that several different configurations of applying air to the piston base portion 928 may be used without departing from the scope of the present general inventive concept. The rearmost portion of the piston base portion 928 may be referred to as the primary piston head surface 948, and is the portion of the piston 920 to which the high pressure air from the ports 946 will be applied. The opposite end of the piston base portion 928 may be referred to as the secondary piston head surface 950, and will be discussed in further detail later in this description. Located substantially inside the piston base portion 928 is the piston insert 940, which is biased in a direction of the distal end of the piston base portion 928 by a spring 952. The piston insert 940, which is connected at a distal end to the nozzle 922, is configured to be able to move relative to the piston base portion 928 in a space created by the inner surface of the piston base portion 928, and in and out of an opening in a piston head portion 926 of the piston 920. In the example embodiment illustrated in FIG. 9, one end of the spring 952 rests in a recess at the end of the central head member 944 of the solenoid 930, and a second end of the spring 952 abuts a ridge located on an inner surface of the piston insert 940. Thus, the piston insert 940 is biased toward the piston head portion 926 of the piston 920, and is stopped there in a "back" position of the piston 920 due to a tapered portion of the piston insert 940 abutting the inside of the piston head portion 926, just opposite the secondary piston head surface 950. These surfaces will encounter different configurations in the actions involved in firing the piston, as will be described in the discussion of FIGS. 10-13. It is noted that the example embodiment illustrated in FIG. 9 simply shows one way in which the piston insert 940 may be biased, and it is possible to bias the piston insert 940 in other ways without departing from the scope of the present general inventive concept.

To move the piston 920, high pressure air enters the assembly through an air input channel 912 toward a solenoid input channel 914 in the solenoid 930. Within the solenoid 930 is a valve that is capable of switching between a closed state and an open state. When a trigger mechanism of the airsoft gun, or other device employing the cylinder-nozzle assembly 900, activates the solenoid 930, the valve within the solenoid 930 switches into the open state, allowing the passage of the high pressure air from the air input channel 912 through the solenoid input channel 914 and solenoid 930 and to the air ports 946 provided in the central head member 944 proximate to the primary piston head surface 948 at the piston base portion 928. The pressure of the high pressure air moving through the air ports 946 to the piston base portion 928 forces the piston base portion 928 to start moving away from the solenoid 930. As previously noted, different example embodiments may include a host of different configurations for moving the high pressure air to the piston 920 without departing from the scope of the present general inventive concept.

Figure 10:
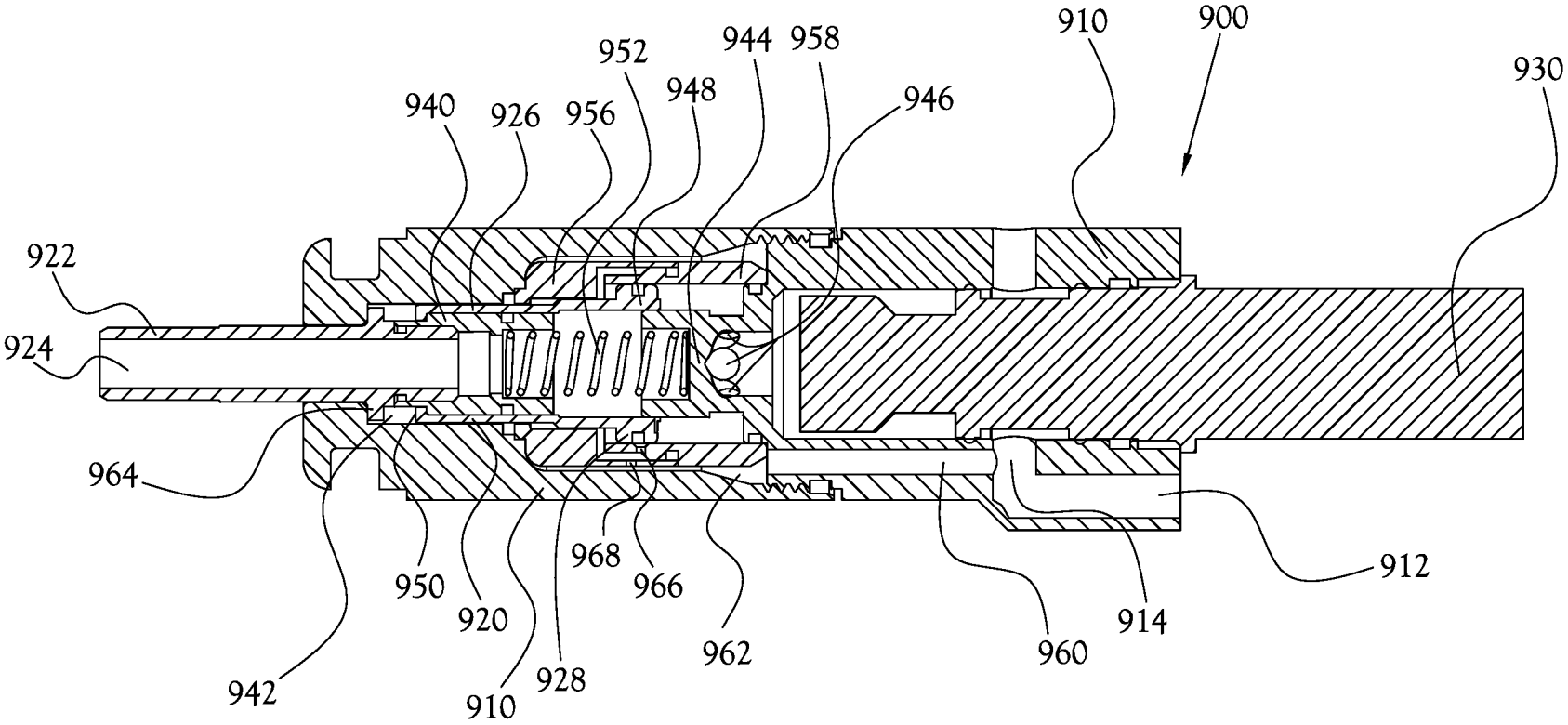
FIG. 10 illustrates a stage of forward movement of the piston configuration illustrated in FIG. 9.

FIG. 10 illustrates a stage of forward movement of the piston configuration illustrated in FIG. 9. As the high pressure air acts upon the piston base portion 928, the piston base portion 928 begins to move forward in the cylinder-nozzle assembly 900. The movement of the piston base portion 928 in this example embodiment is guided and limited by a two-piece baffle member 956,958, alternatively referred to herein as a forward baffle section 956 and rearward baffle section 958, that substantially encloses the piston base portion 928. As illustrated in FIGS. 9-10, the rearward baffle section 958 is coupled to the solenoid 930 around the piston base portion 928 and the central head member 944, and the forward baffle section 956 is coupled to the rearward baffle section 958 so as to form an auxiliary line 962 which will guide high pressure air to aid movement of the piston in a manner which will be discussed in more detail later in this description. The space in which the piston base portion 928 moves is formed by the two-piece baffle member 956,958. As illustrated in FIG. 10, as the piston base portion 928 begins to move forward in the cylinder-nozzle assembly 900, the piston insert 940 and nozzle 922 also begin to move in the forward direction. This is due to the piston insert 940 being biased by the spring 952, which is connected to the nozzle 922, to extend as far as structurally allowed. Therefore, for at least an initial stage of forward movement, the piston insert 940 and nozzle 922 move forward along with the piston base portion 928. As illustrated in FIG. 10, an effective antepiston chamber is formed behind the piston base portion 928 in which high pressure air is collecting while also moving the piston assembly. The two-piece baffle member 956,958 restricts some of the air flow during forward movement of the piston insert 940 and nozzle 922. As illustrated in FIGS. 9-10, a hole 966 is formed in the rearward baffle section 958, and a hole 968 is formed in the forward baffle section 956. During the forward movement illustrated in these figures, air from the auxiliary line is able to move through the metered holes 966,968 in the baffle member 956,958 and into the space forward of the piston base portion 928, which builds pressure in that space and slows the nozzle movement down slightly before the piston base portion 928 moves over the holes 966,968.

As illustrated in FIG. 10, the forward movement of the nozzle 922 and piston head portion 926 is limited by contact between a nozzle ridge 964 provided on an outer surface of the nozzle 922 and an inner surface of the cylinder-nozzle assembly 900. When the nozzle ridge 964 contacts the cylinder-nozzle assembly 900, the nozzle 922 can move no further in the forward direction, and the piston insert 940 is also stopped by the nozzle's inability to move further, in spite of the bias of the spring 952, because of the structural coupling to the nozzle 922. The piston base portion 928, however, is configured to move relative to the piston insert 940 and nozzle 922, and therefore is free to move further in the forward direction. The piston base portion 928 also temporarily closes the hole 966 in the rearward baffle section 958, stopping that path of air that was slowing nozzle movement in the forward direction.

Figure 11:
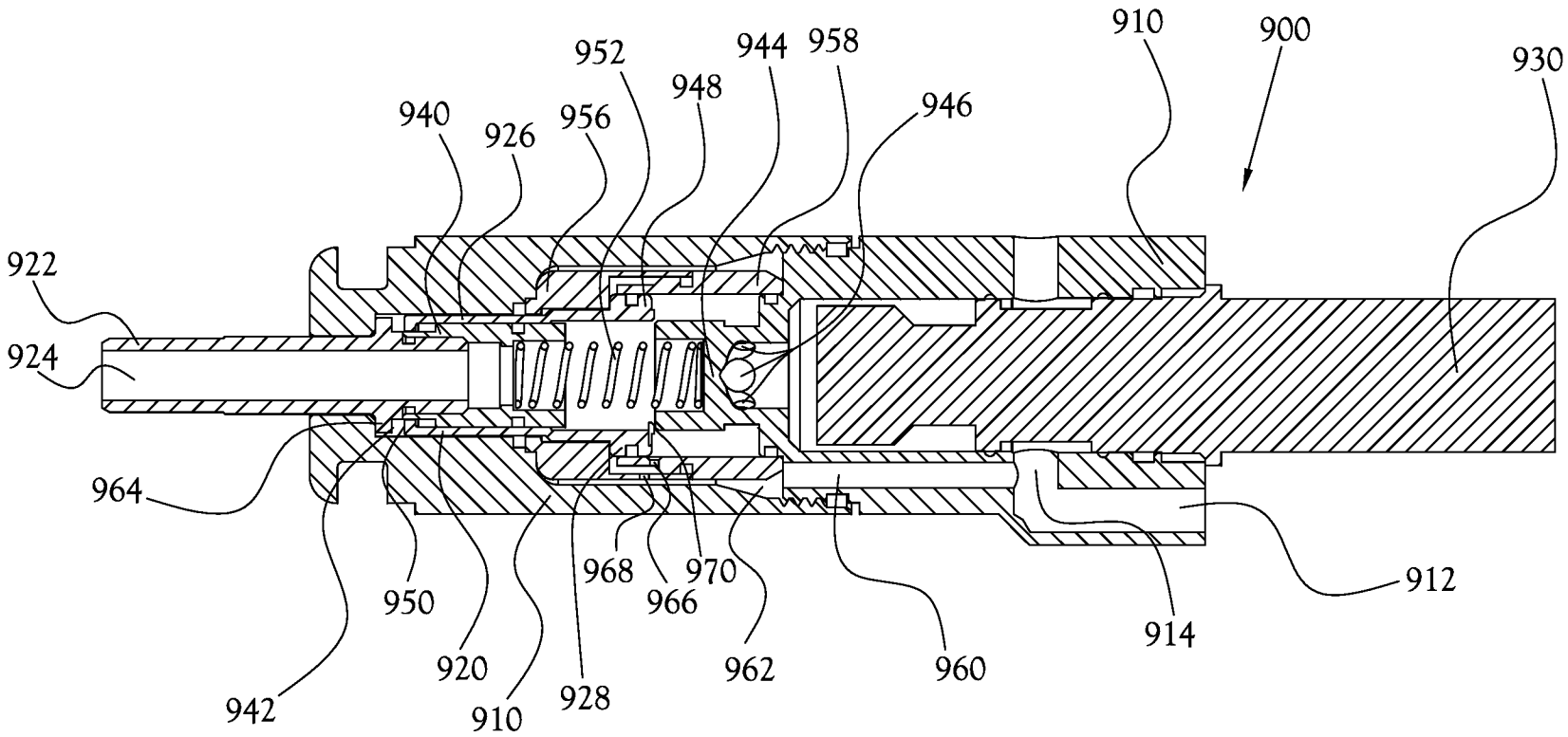
FIG. 11 illustrates a further stage of forward movement of the piston base portion of the piston configuration illustrated in FIGS. 9-10.

FIG. 11 illustrates a further stage of forward movement of the piston base portion of the piston configuration illustrated in FIGS. 9-10. As illustrated in FIG. 10, the forward movement of the piston insert 940 and nozzle 922 was previously stopped by the nozzle ridge 964 contacting the inner surface of the cylinder-nozzle assembly 900. However, the piston base portion 928 continues to move, due to the high pressure air from the solenoid 930, until a ridge formed proximate the rear of the piston base portion 928 contacts the inner surface of the forward baffle section 956, at which any further forward progress of the piston base portion 928 is impeded. Thus, none of the parts of the piston 920 assembly are able to move further at the point illustrated in FIG. 11, which is the "forward" position of the piston 920 assembly. When the piston base portion 928 has reached this farthest point of movement, an opening 970 is formed between the piston base portion 928 and the central head member 944, and high pressure air from the solenoid is free to travel through the opening 970 and pass through the central air channel 924 defined by the nozzle 922. The forward position of the piston assembly 920 also opens the hole 966 in the rearward baffle section 958, which provides air pressure to release from behind the piston base portion 928 to provide an extra boost in the last bit of travel of the piston assembly 920. The delivery of air pressure through the holes 966,968 of the two-piece baffle member 956,958, as described herein, allows the nozzle assembly to move forward with a slightly slowed movement, and then be boosted to move more quickly in the last segment of travel, which smooths the action of the projectile, and opens the overall air pathway more quickly so that loss of power is minimized. Various seals are provided to the various components of the assembly to prevent the loss of the pressurized air in between moving or otherwise coupled parts.

Figure 12:
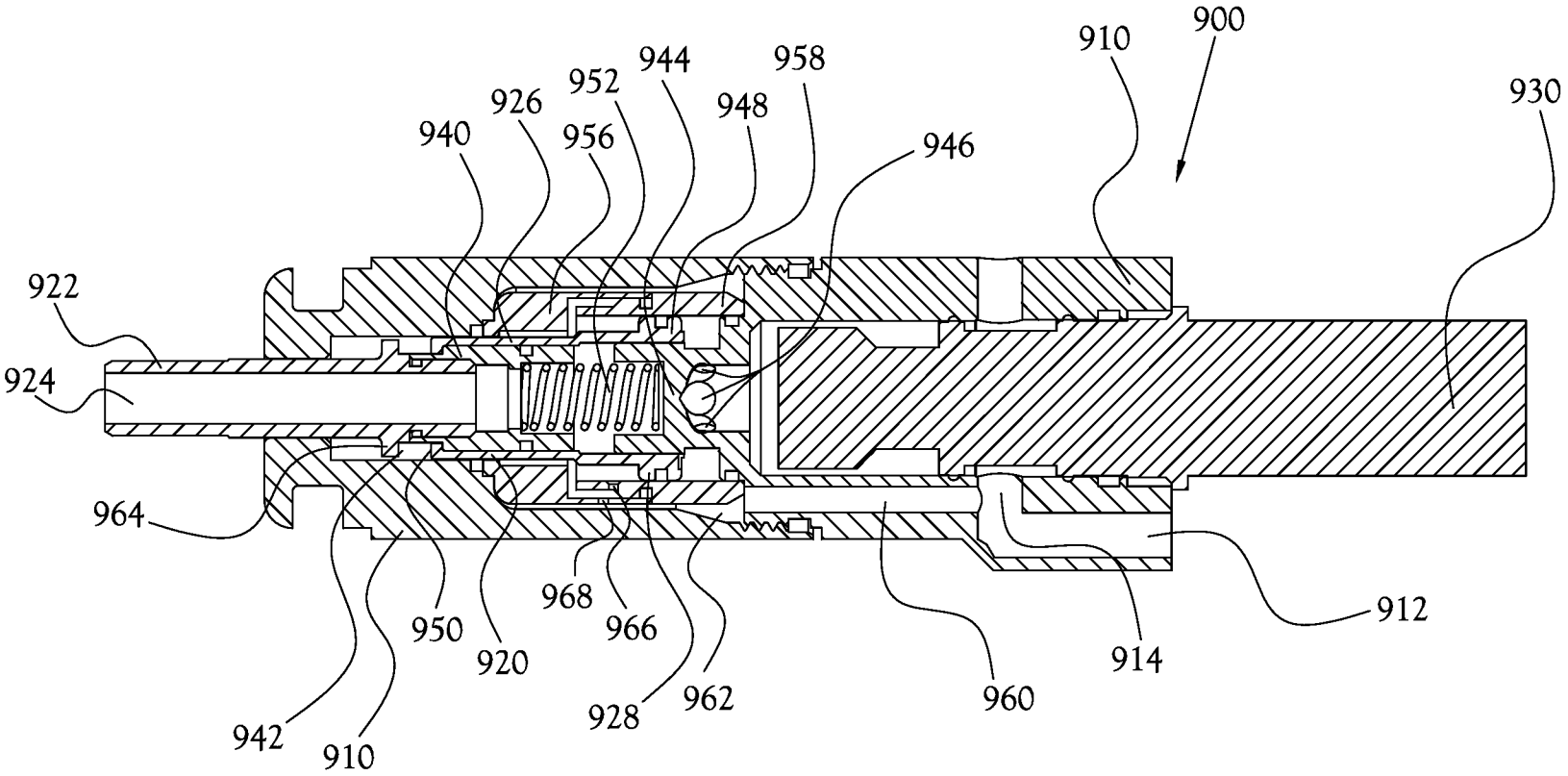
FIG. 12 illustrates a stage of backward movement of the piston base portion of the piston configuration illustrated in FIGS. 9-11.
Figure 13:
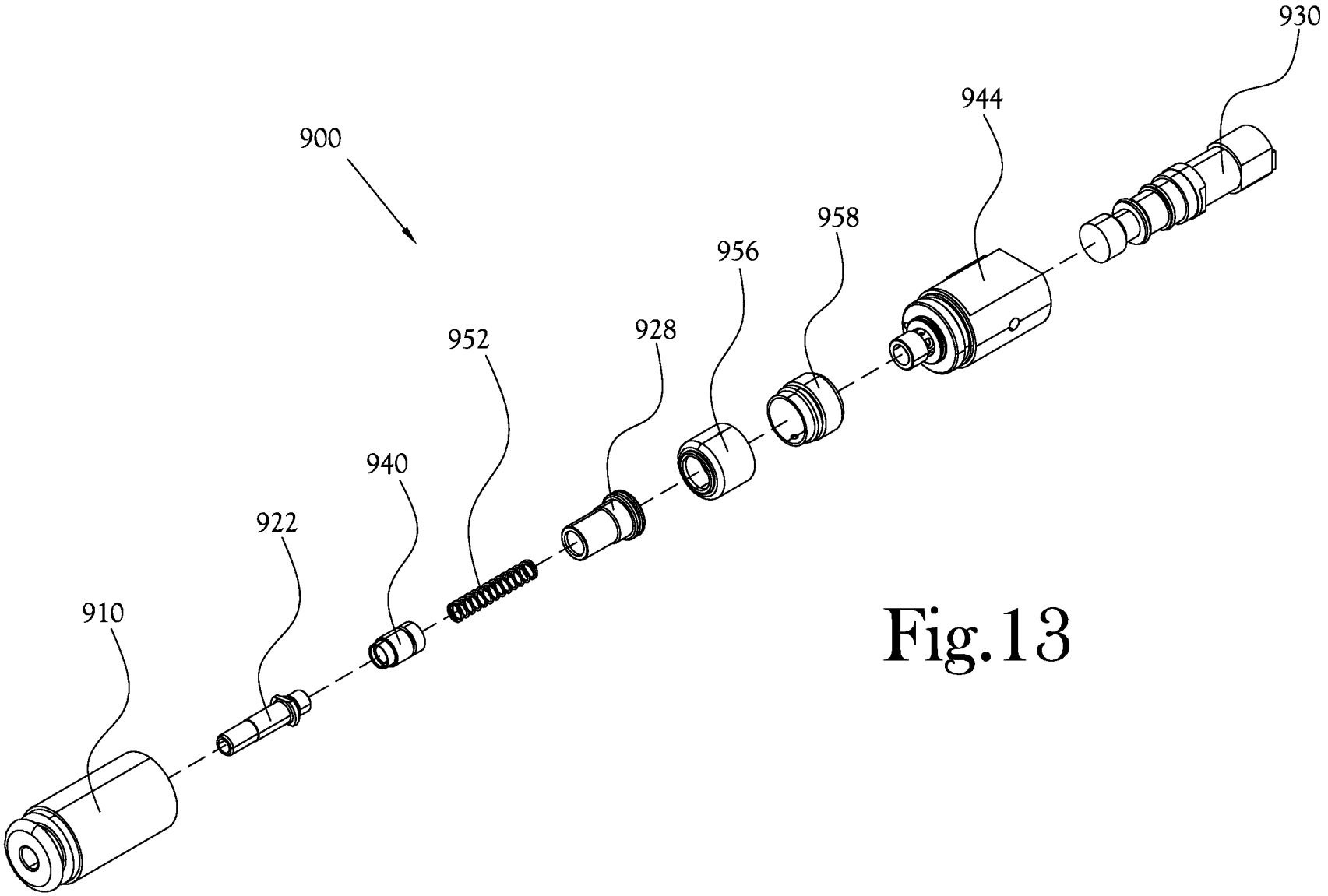
FIG. 13 illustrates an exploded view of various components of the cylinder-nozzle assembly illustrated in FIG. 9.

After a predetermined amount of time that is configured to allow a certain amount of pressurized air to pass through the central air channel 924, the valve within the solenoid closes, and the high pressure air traveling through the air input channel 912 of the cylinder-nozzle assembly 900 is diverted so as to travel through an auxiliary tube 960 leading to the cylinder-frame body 910 rather than the solenoid input channel 914. FIG. 12 illustrates a stage of backward movement of the piston base portion of the piston configuration illustrated in FIGS. 9-11. As previously described, when the piston assembly 920 reaches its forward most position, the hole 966 in the rearward baffle section 958, which was previously blocked by the piston base portion 928, is left open, and remaining air in the space formed by the two-piece baffle member 956,958 behind the piston base portion 928 may be directed through the hole 966 into a space between the forward baffle section 956 and rearward baffle section 958. This space is also accessed by the hole 968 in the forward baffle section 956 that is fed by the auxiliary line 962. Remaining air from the space behind the piston base portion 928 may enter the hole 966 in the rearward baffle section and move through the space between the forward baffle section 956 and rearward baffle section 958 to begin the pushing back of the piston base portion illustrated in FIG. 12. As illustrated in FIG. 12, and similar to the action described in the forward movement of the piston assembly, high pressure air delivered through the auxiliary line 962 is introduced to the space between the rearward baffle section 958 and forward baffle section 956 through the hole 968, which causes backward pressure on the ridge formed proximate the rear of the piston base portion 928. As illustrated in FIG. 12, the piston base portion 928 has begun to move backward toward the "back" position. However, it is noted that the piston insert 940 and nozzle 922 initially remain in the "forward" position, due to the bias of the spring 952 on the piston insert 940. This action continues until the piston head portion 926 that stops forward movement of the piston insert 940 in the "back" position again contacts the piston insert 940 while the piston base portion 928 is traveling backward. FIG. 12 illustrates the contact between the piston base portion 928 and the piston insert 940, at which point the pressurized air moving through the auxiliary tube 960 and auxiliary line 962 forces the entire piston 920 assembly to move backward to the "back" position, which was the initial position illustrated in FIG. 9. FIG. 13 illustrates an exploded view of various components of the cylinder-nozzle assembly illustrated in FIG. 9.

Although the example embodiment described above and illustrated in FIGS. 9-13 includes a piston assembly having a piston base portion that moves in concert with the nozzle in an initial stage of forward movement, various other example embodiments may include a piston assembly in which the piston base portion moves independently of the nozzle in the initial stage of forward movement, and in which the nozzle moves with the piston base portion in a later stage of the forward movement. In various example embodiment in which the piston base portion moves independently in the initial stage of forward movement, the nozzle may be biased in a backward movement direction. Also, other example embodiments of the present general inventive concept may include an antepiston chamber as illustrated in FIG. 1 to which pressurized air is initially ported before moving the piston base portion in a multi-stage piston assembly movement.

In various example embodiments of the present general inventive concept, a high pressure air cylinder-nozzle assembly is provided which includes a cylinder frame body, a piston assembly including a piston base member and a nozzle, the piston base member being configured to move along an axis in the cylinder frame body relative to the nozzle in at least one stage of multi-stage piston assembly movements between forward and back positions, and simultaneously with the nozzle in at least another stage of the multi-stage piston assembly movements, and a solenoid valve to direct air to the piston base member to move the piston base member between the forward and back positions. A physical coupling of the piston base member and the nozzle may cause the simultaneous movement of the piston base member and the nozzle in the at least another stage of the multi-stage piston assembly movements. The high pressure air cylinder-nozzle may further include a biasing member configure to bias the nozzle in a forward direction such that the nozzle moves simultaneously with the piston base member in the at least another stage of the multi-stage piston assembly movements. The biasing member may be a spring having a first end contacting a solenoid body containing the solenoid valve, and a second end coupled to the nozzle. The high pressure air cylinder-nozzle assembly may further include a piston insert provided inside the piston base member between the spring and the nozzle and coupled to the nozzle, the piston insert being configured physically interact with the piston base member to simultaneously move the nozzle in the at least another stage of the multi-stage piston assembly movements. The high pressure air cylinder-nozzle assembly may further include a central head member at a forward end of the solenoid, the central head member being configured to receive the first end of the spring. The central head member may be configured so as to have a neck of reduced diameter relative to a distal end of the central head member, and at least one pressurized air port provided to the neck to deliver pressurized air to the piston base member. The piston base member may be configured to receive and surround the central head member in the back position. The nozzle may be configured with a protruding member on an outer diameter thereof, the protruding member being configured to abut an inner surface of the cylinder frame body at a certain point along a forward movement of the piston assembly. A first stage of forward movement of the piston assembly may include the piston base member and the nozzle moving forward until the protruding member contacts the inner surface of the cylinder frame to stop movement of the nozzle, and a second stage of forward movement of the piston assembly includes the piston base member continuing to move forward until progress is physically impeded. The high pressure air cylinder-nozzle assembly may further include a baffle member at least partially enclosing the piston base member, and configured such that a portion of the piston base member contacts a portion of the baffle member to stop forward progress of the piston base member during a forward movement. An opening may be created when the piston base member approaches an end of the forward movement, the opening allowing air from the solenoid valve to move through a central air channel formed in the nozzle. The solenoid valve may close after a predetermined time has passed since the piston base member completed the forward movement to the forward position. The high pressure air cylinder-nozzle assembly may further include an auxiliary air channel provided in the cylinder frame body to deliver air to a front portion of the piston base member when the solenoid valve is closed to force the piston base portion into a first stage of a backward movement. The piston base member may be physically coupled to the nozzle after a certain length of backward movement relative to the nozzle, causing simultaneous movement with the nozzle until the piston assembly reaches the back position. The solenoid valve may be a two-way valve. The high pressure cylinder-nozzle assembly may be used in an airsoft gun. An antepiston chamber may be formed behind the piston base member during forward movement of the piston base member.

In various example embodiments of the present general inventive concept, a high pressure air cylinder-nozzle assembly is provided which includes a solenoid having a solenoid valve, and a piston assembly including a piston base member and a nozzle to deliver high pressure air from the solenoid valve through a central air channel formed in the nozzle, wherein the high pressure air from the solenoid valve moves the piston assembly forward to create an opening to the central air channel, and wherein the piston base member moves relative to the nozzle during a portion of the forward movement, and simultaneously with the nozzle during another portion of the forward movement. The closing of the solenoid valve may redirect high pressure air to move the piston assembly backward to a back position such that the piston base member moves relative to the nozzle during a portion of the backward movement, and simultaneously with the nozzle during another portion of the backward movement.

Numerous variations, modifications, and additional embodiments are possible, and accordingly, all such variations, modifications, and embodiments are to be regarded as being within the spirit and scope of the present general inventive concept. For example, regardless of the content of any portion of this application, unless clearly specified to the contrary, there is no requirement for the inclusion in any claim herein or of any application claiming priority hereto of any particular described or illustrated activity or element, any particular sequence of such activities, or any particular interrelationship of such elements. Moreover, any activity can be repeated, any activity can be performed by multiple entities, and/or any element can be duplicated.

It is noted that the simplified diagrams, drawings, and photographs included in the present application do not illustrate all the various connections and assemblies of the various components, however, those skilled in the art will understand how to implement such connections and assemblies, based on the illustrated components, figures, and descriptions provided herein, using sound engineering judgment. Numerous variations, modification, and additional embodiments are possible, and, accordingly, all such variations, modifications, and embodiments are to be regarded as being within the spirit and scope of the present general inventive concept.

While the present general inventive concept has been illustrated by description of several example embodiments, and while the illustrative embodiments have been described in detail, it is not the intention of the applicant to restrict or in any way limit the scope of the general inventive concept to such descriptions and illustrations. Instead, the descriptions, drawings, photographs, and claims herein are to be regarded as illustrative in nature, and not as restrictive, and additional embodiments will readily appear to those skilled in the art upon reading the above description and drawings. Additional modifications will readily appear to those skilled in the art. Accordingly, departures may be made from such details without departing from the spirit or scope of applicant's general inventive concept.

The invention claimed is:

1. A high pressure air cylinder-nozzle assembly configured for use with a gun, comprising:

a cylinder frame body;

a piston assembly including a piston base and a nozzle, the piston assembly defining a central air channel through the piston base and nozzle, the piston base being configured to move along an axis in the cylinder frame body relative to the nozzle in at least one stage of multi-stage piston assembly movements between forward and back positions, and simultaneously with the nozzle in at least another stage of the multi-stage piston assembly movements; and a solenoid valve configured to direct air to the piston base to move the piston base between the forward and back positions.

2. The high pressure air cylinder-nozzle assembly of claim 1, wherein a physical coupling of the piston base and the nozzle causes the simultaneous movement of the piston base and the nozzle in the at least another stage of the multi-stage piston assembly movements.

3. The high pressure air cylinder-nozzle assembly of claim 1, further including a biasing member configured to bias the nozzle in a forward direction such that the nozzle moves simultaneously with the piston base in the at least another stage of the multi-stage piston assembly movements.

4. The high pressure air cylinder-nozzle assembly of claim 3, wherein the biasing member is a spring having a first end contacting a solenoid body containing the solenoid valve, and a second end coupled to the nozzle.

5. The high pressure air cylinder-nozzle assembly of claim 4, further comprising a piston insert provided inside the piston base between the spring and the nozzle and coupled to the nozzle, the piston insert being configured to physically interact with the piston base to simultaneously move the nozzle in the at least another stage of the multi-stage piston assembly movements.

6. The high pressure air cylinder-nozzle assembly of claim 5, further comprising a central head member at a forward end of the solenoid body, the central head member being configured to receive the first end of the spring.

7. The high pressure air cylinder-nozzle assembly of claim 3, wherein the nozzle is configured with a protruding member on an outer diameter thereof, the protruding member being configured to abut an inner surface of the cylinder frame body at a certain point along a forward movement of the piston assembly.

8. The high pressure air cylinder-nozzle assembly of claim 7, wherein a first stage of forward movement of the piston assembly includes the piston base member and the nozzle moving forward until the protruding member contacts the inner surface of the cylinder frame to stop movement of the nozzle, and a second stage of forward movement of the piston assembly includes the piston base member continuing to move forward until progress is physically impeded.

9. The high pressure air cylinder-nozzle assembly of claim 8, further comprising a baffle member at least partially enclosing the piston base member, and configured such that a portion of the piston base member contacts a portion of the baffle member to stop forward progress of the piston base member during a forward movement.

10. The high pressure air cylinder-nozzle assembly of claim 9, wherein an opening is created when the piston base member approaches an end of the forward movement, the opening allowing air from the solenoid valve to move through a central air channel formed in the nozzle.

11. The high pressure air cylinder-nozzle assembly of claim 9, wherein the solenoid valve closes after a predetermined time has passed since the piston base member completed the forward movement to the forward position.

12. The high pressure air cylinder-nozzle assembly of claim 11, further comprising an auxiliary air channel provided in the cylinder frame body to deliver air to a front portion of the piston base member when the solenoid valve is closed to force the piston base portion into a first stage of a backward movement.

13. The high pressure air cylinder-nozzle assembly of claim 12, wherein the piston base member is physically coupled to the nozzle after a certain length of backward movement relative to the nozzle, causing simultaneous movement with the nozzle until the piston assembly reaches the back position.

14. The high pressure air cylinder-nozzle assembly of claim 1, wherein the solenoid valve is a two-way valve.

15. The high pressure air cylinder-nozzle assembly of claim 1, wherein the gun is an airsoft gun.

16. The high pressure air cylinder-nozzle assembly of claim 1, wherein an antepiston chamber is formed behind the piston base during forward movement of the piston base.

17. A high pressure air cylinder-nozzle assembly configured for use with a gun, comprising:

a solenoid having a solenoid valve; and a piston assembly including a piston base member and a nozzle to deliver high pressure air from the solenoid valve through a central air channel formed in the nozzle;

wherein the high pressure air from the solenoid valve moves the piston assembly forward to create an opening to the central air channel; and wherein the piston base member moves relative to the nozzle during a portion of the forward movement, and simultaneously with the nozzle during another portion of the forward movement.

18. The high pressure air cylinder-nozzle assembly of claim 17, wherein closing of the solenoid valve redirects high pressure air to move the piston assembly backward to a back position such that the piston base member moves relative to the nozzle during a portion of the backward movement, and simultaneously with the nozzle during another portion of the backward movement.

* * * * *